US005174114A

United States Patent [19]

Aoyagi

[11] Patent Number: 5,174,114

[45] Date of Patent: Dec. 29, 1992

[54] HYDRAULIC DRIVE SYSTEM FOR CONSTRUCTION MACHINE

[75] Inventor: Yukio Aoyagi, Ibaraki, Japan

[73] Assignee: Hitachi Construction Machinery Co., Ltd., Tokyo, Japan

[21] Appl. No.: 721,467

[22] PCT Filed: Feb. 27, 1991

[86] PCT No.: PCT/JP91/00260

§ 371 Date: Jul. 9, 1991

§ 102(e) Date: Jul. 9, 1991

[87] PCT Pub. No.: WO91/13217

PCT Pub. Date: Sep. 5, 1991

[30] Foreign Application Priority Data

Feb. 28, 1990 [JP] Japan ..... 2-45828
Feb. 28, 1990 [JP] Japan ..... 2-45829

[51] Int. Cl.[5] ..... F15B 11/08; F16D 31/02

[52] U.S. Cl. ..... 91/446; 60/426; 60/431; 60/452

[58] Field of Search ..... 60/426, 427, 431, 434, 60/445, 449, 452, 459, 465; 91/446, 518

[56] References Cited

U.S. PATENT DOCUMENTS 3,579,987 5/1971 Busse ..... 60/426 X
4,850,191 7/1989 Kreth et al. ..... 60/426 X
4,856,278 8/1989 Widmann et al. ..... 60/426 X
4,870,819 10/1989 Walzer ..... 60/422 X
4,967,557 11/1990 Izumi et al. ..... 60/423
5,048,293 9/1991 Aoyagi ..... 60/427 X
5,085,051 2/1992 Hirata ..... 60/452 X

*Primary Examiner*—Edward K. Look
*Assistant Examiner*—Hoang Nguyen
*Attorney, Agent, or Firm*—Fay, Sharpe, Beall, Fagan, Minnich & McKee

[57] ABSTRACT

A construction machine has a flow control device (2, 8, 10) for controlling a flow rate of the hydraulic fluid supplied to an actuator, and a pump control device (2, 40, 42) for controlling a delivery rate of the hydraulic pump such that the pump delivery rate is reduced as a load of the actuator increases, and is increased as the load of the actuator decreases. A magnitude of the load exerted on the actuator is detected (6), and an abrupt reduction in the load of the actuator based on the detected load is monitored. The hydraulic fluid supplied to the actuator is limited when it is determined that the actuator has reached a predetermined condition related to an abrupt reduction in the load, for the purpose of preventing an abrupt increase in the actuator speed incidental to an abrupt drop of the load not occurring during ordinary work.

12 Claims, 12 Drawing Sheets

HYDRAULIC DRIVE SYSTEM FOR CONSTRUCTION MACHINE

FIELD OF THE INVENTION

The present invention relates to a hydraulic drive system for construction machines such as hydraulic excavators, and more particularly to a hydraulic drive system equipped with pump control means for controlling a pump delivery rate to the rate as the load exerted on an actuator is increased and to increase it as the load is reduced.

BACKGROUND OF THE INVENTION

A conventional hydraulic drive system for construction machines comprises, as disclosed in U.S. Pat. No. 4,967,557 by way of example, a hydraulic pump of variable displacement type, a plurality of hydraulic actuators driven by a hydraulic fluid supplied from the hydraulic pump, a plurality of flow control valves for controlling respective flows of the hydraulic fluid supplied to the hydraulic actuators, a plurality of pressure compensating valves for controlling respective differential pressures across the flow control valves, and a pump controller for controlling a delivery rate of the hydraulic pump. The pump controller has a function of input torque limiting control with which the delivery rate of the hydraulic pump is controlled to reduce as a pump delivery pressure is increased and to increased as it is reduced. In the case that the construction machine is a hydraulic excavator, the plurality of actuators include ones such as a boom cylinder, arm cylinder, bucket cylinder and swing motor, which actuators drive working members such as a boom, arm, bucket and swing, respectively.

When one of the flow control valves is shifted by a control lever, the hydraulic fluid is supplied at the flow rate controlled by that flow control valve to the corresponding actuators such as the boom cylinder, arm cylinder or bucket cylinder, thereby carrying out work such as digging of sand and earth. During this work, when the load exerted on the actuator is large and the pump delivery pressure exceeds a predetermined value, the input torque limiting control of the pump controller takes places so that the pump delivery rate is reduced to prevent an engine from stalling.

In an attempt of carrying out a digging work by the hydraulic excavator thus arranged, when the digging work is performed on rocks, it may often occur that a finger tip of the bucket is caught by the rock and then slips off therefrom to bring about a sudden change from a condition under high load pressure due to the increased digging resistance into a condition of non-load. In the event of such a sudden change into the non-load condition, because the pump controller continues the input torque limiting control as mentioned above, the flow rate of the hydraulic fluid supplied to the actuator such as the bucket cylinder or the arm cylinder is abruptly changed. This tends to invite an inconvenience that the actuator speed is raised up beyond a required level and the bucket is excessively accelerated to strike against the rock intended by an operator to be next dug. The occurrence of such a collision imposes a heavy impact load on the hydraulic excavator body, hydraulic system and so forth, and thus remarkably cuts down on the service life of the hydraulic excavator as a structure. Further, the above collision transmits a heavy impact to an operating cab installed on the machine body as well, making the operator in the cab more fatigued.

The present invention has been made in view of the above-described state in the prior art, and has for its object to provide a hydraulic drive system for construction machines which can prevent an abrupt increase in the speed of a hydraulic actuator incidental to such an abrupt drop of the load as not caused during an ordinary work.

SUMMARY OF THE INVENTION

To achieve the above object, the present invention provides a hydraulic drive system for a construction machine comprising a hydraulic pump of variable displacement type, a hydraulic actuator driven by a hydraulic fluid delivered from said hydraulic pump, flow control means for controlling a flow rate of the hydraulic fluid supplied to said actuator, and pump control means for controlling a delivery rate of said hydraulic pump such that the pump delivery rate is reduced as a load of said actuator increases, and is increased as the load of said actuator reduces, wherein the hydraulic drive system further comprises first detection means for detecting a magnitude of the load exerted on said actuator, and flow limiting means for monitoring an abrupt reduction in the load of said actuator based on a signal from said first detection means, and controlling said flow control means to limit a flow increase speed of the hydraulic fluid supplied to said actuator when it is determined that said actuator has reached a predetermined condition related to an abrupt reduction in the load.

With the present invention thus arranged, when the actuator is determined as having reached a predetermined condition related to an abrupt reduction in the load, the flow increase speed of the hydraulic fluid supplied to the actuator is limited so that an acceleration of the hydraulic actuator is suppressed to a value smaller than that during the ordinary work and an increase in the actuator speed is also suppressed. Accordingly, the present hydraulic drive system can prevent an abrupt increase in the speed of the hydraulic actuator incidental to such an abrupt drop of the load as not caused during the ordinary work.

In the hydraulic drive system of the present invention, the flow limiting means is preferably pump flow limiting means for limiting an increase in speed of the delivery rate of the hydraulic pump controlled by the pump flow control means when it is determined that the actuator has reached a predetermined condition related to an abrupt reduction in the load. On this occasion, in the hydraulic drive system where the pump flow control means includes means for calculating a first displacement volume target value for the input torque limiting control of the hydraulic pump, the pump flow limiting means preferably includes means for calculating a second displacement volume target value to limit an increase speed of the pump delivery rate, and means for selecting a smaller value of the first displacement volume target value and the second displacement volume target value, and outputting the selected value as a displacement volume command value.

In the hydraulic drive system where the flow control means includes a flow control valve for controlling the flow rate of the hydraulic fluid supplied from the hydraulic pump to the actuator, and a pressure compensating valve for controlling a differential pressure across the flow control valve, the flow limiting means may be valve control means for controlling a drive speed of the pressure compensating valve in the valve-opening direction and limiting an increase in speed of the flow rate passing through the flow control valve when it is determined that the actuator has reached a predetermined condition related to an abrupt reduction in the load. On this occasion, in the hydraulic drive system further comprising second detection means for detecting a differential pressure between a delivery pressure of the hydraulic pump and a load pressure of the actuator, and means for calculating a first control force target value that causes a compensated differential pressure target value of the pressure compensating valve to become smaller as the differential pressure is reduced, and to become larger as the differential pressure is increased, the valve limiting means preferably includes means for calculating a second control force target value to limit an increase in speed of the flow rate passing through the flow control valve, and means for selecting a smaller value of the first control force target value and the second control force target value, and outputting the selected value as a command value.

Further, in the hydraulic drive system of the present invention, the flow limiting means preferably includes setting means for setting a first flow rate increment giving a flow increase speed adapted for an ordinary work and a second flow rate increment smaller than the first flow rate increment, selection means for selecting the first flow rate increment when it is not determined that the actuator has reached a predetermined condition related to an abrupt reduction in the load, and selecting the second flow rate increment when it is determined that the actuator has reached a predetermined condition related to an abrupt reduction in the load, and arithmetic means for calculating a control target value of the flow rate supplied to the actuator based on the selected flow rate increment. On this occasion, the setting means may includes means for storing a plurality of different flow rate increments, and means operable externally for selecting one of those increments as the second flow rate increment dependent upon the operation thereof. The second flow rate increment may be 0 or a time-dependent variable value.

Moreover, in the hydraulic drive system of the present invention, the flow limiting means preferably includes means for calculating a magnitude decrease speed of the load of the actuator based on a signal from the first detection means, and means for detemining that the actuator has reached a predetermined condition related to an abrupt reduction in the load, when the load magnitude decrease speed is larger than a predetermined value and the load of the actuator is larger than a predetermined value. The flow limiting means may include means for determining that the actuator has reached a predetermined condition related to an abrupt reduction in the load, when the load of the actuator detected by the first detection means is larger than a predetermined value.

Finally, in the hydraulic drive system of the present invention, the first detection means is preferably means for detecting a delivery pressure of the hydraulic pump.

BEST MODE FOR CARRYING OUT THE INVENTION

Hereinafter, preferred embodiments of a hydraulic drive system for construction machines of the present invention will be described in conjunction with the drawings.

First Embodiment

To begin with, a first embodiment of the present invention will be described with reference to FIGS. 1–7.

Figure 1:
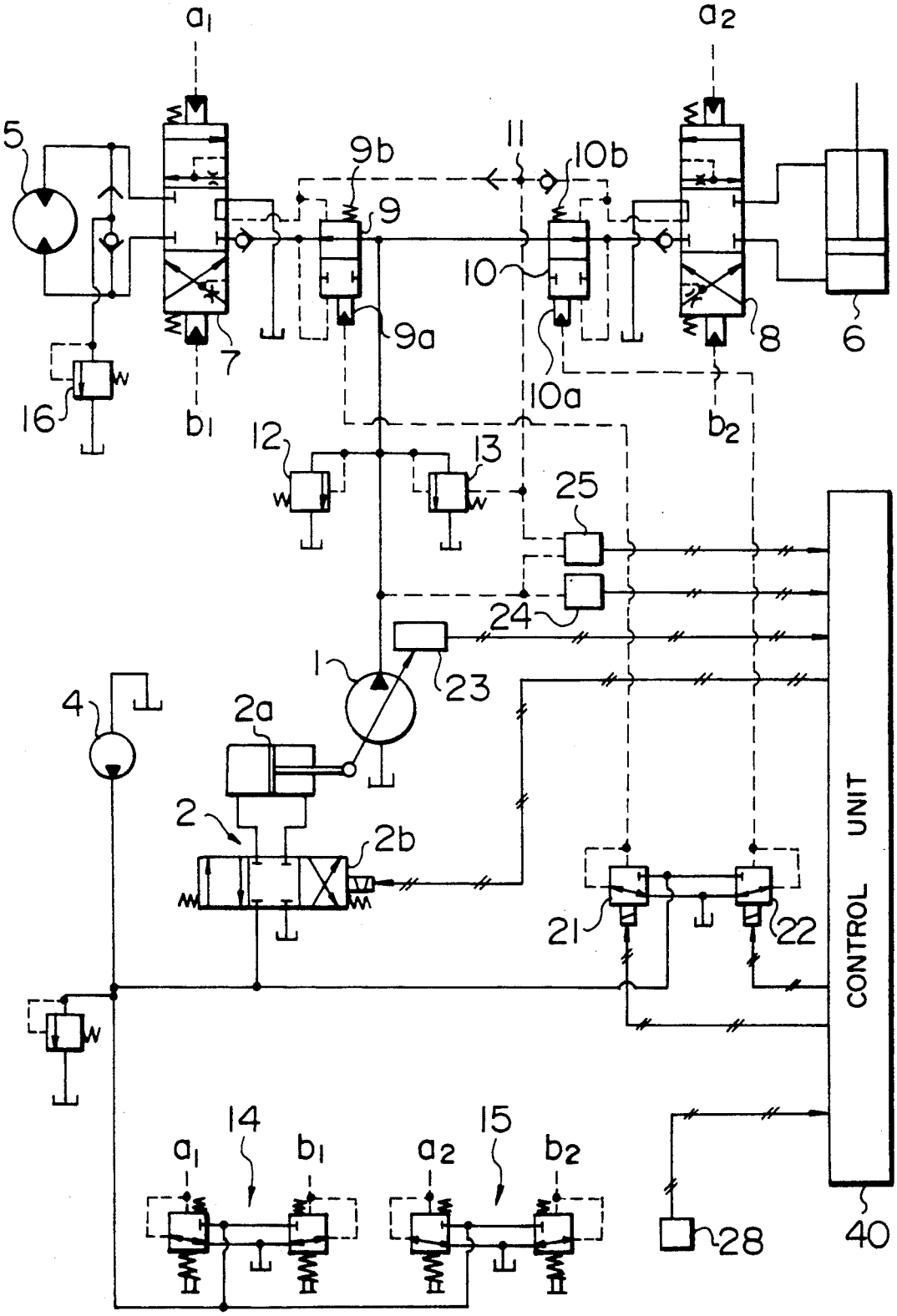
FIG. 1 is a schematic view of a hydraulic drive system for construction machines according to a first embodiment of the present invention.

In FIG. 1, a hydraulic drive system of this embodiment comprises a hydraulic pump 1 of variable displacement type, and a pump capacity regulation device 2 for controlling the displacement volume, that is, a swash plate tilting angle, of the hydraulic pump 1. The pump capacity regulation device 2 comprises a control actuator 2*a* for driving a swash plate of the hydraulic pump 1, and a flow adjusting valve 2*b* for controlling operation of the control actuator 2*a*. A hydraulic fluid delivered from the hydraulic pump 1 is supplied to hydraulic actuators, for example, a hydraulic motor 5 and a hydraulic cylinder 6, and respective flows of the hydraulic fluid supplied to the hydraulic motor 5 and the hydraulic cylinder 6 are controlled by flow control valves 7 and 8. Pressure compensating valves 9, 10 are respectively disposed upstream of the flow control valves 7, 8 to control differential pressures across the flow control valves 7, 8. A higher one of load pressures of the hydraulic motor 5 and a hydraulic cylinder 6, that is, a maximum load pressure, is detected by a shuttle valve 11.

A maximum delivery pressure of the hydraulic pump 1 is limited by a relief valve 12, whereas a maximum differential pressure between a pump delivery pressure and the above maximum load pressure is limited by an unloading valve 13. Introduced to the unloading valve 13 are the pump delivery pressure and the maximum load pressure detected by the shuttle valve 11.

The flow control valves 7, 8 are each of pilot hydraulic driven type, for example, and are driven with pilot pressures generated dependent upon input amounts of operating devices 14, 15 held in communication with a pilot pump 4, respectively. A maximum load pressure of the hydraulic motor 5 is limited by a relief valve 16. The pressure compensating valves 9, 10 respectively have drive parts 9*a*, 10*a* acting in the valve-closing direction, and springs 9*b*, 10*b* for setting basic compensated differential pressure values. The drive parts 9*a*, 10*a* are loaded with respective pilot pressures outputted from solenoid proportional pressure reducing valves 21, 22 held in communication with the pilot pump 4, so that a control force can be applied to the corresponding drive part against the spring to change a compensated differential pressure target value.

The displacement volume of the hydraulic pump 1 is detected by a displacement detector 23 for detecting a swash plate tilting amount of the hydraulic pump 1, the delivery pressure of the hydraulic pump 1 is detected by a pressure detector 24, and further a differential pressure between the pump delivery pressure and the maximum load pressure is detected by a differential pressure detector 25. Introduced to the differential pressure detector 25 are the pump delivery pressure and the maximum load pressure detected by the shuttle valve 11.

The hydraulic drive system of this embodiment also comprises a selection command unit 28 operable by an operator for externally instructing selection of one of plural different increments of the flow rate to be used for control of limiting a flow increase speed with the present invention, and a control unit 40 for receiving signals from the displacement detector 23, the pressure detector 24, the differential pressure detector 25 and the selection command unit 28 to output drive signals to the flow adjusting valve 2*b* and the solenoid proportional pressure reducing valves 21, 22.

Figure 2:
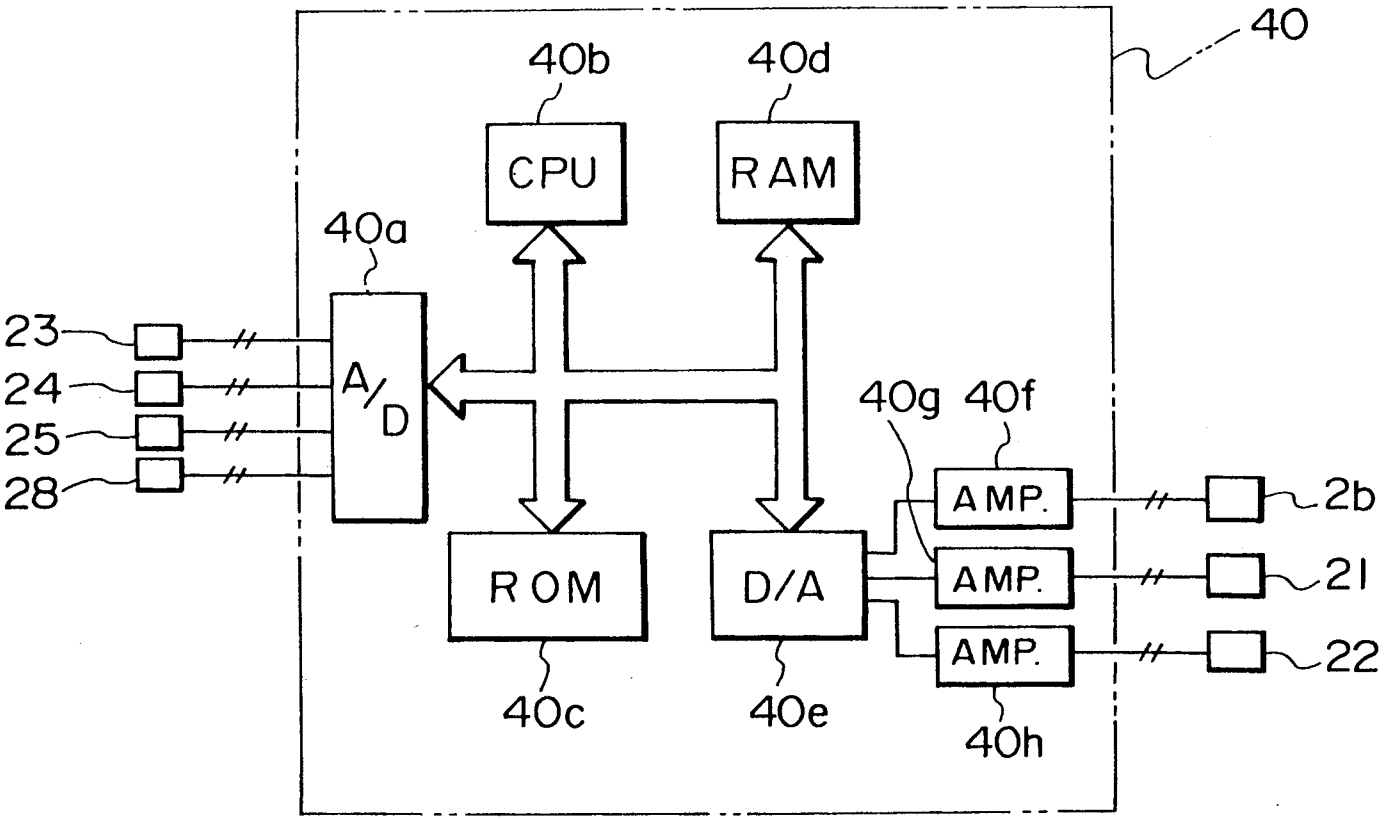
FIG. 2 is a block diagram showing a hardware configuration of a control unit shown in FIG. 1.

The control unit 40 is constituted by a microcomputer and comprises, as shown in FIG. 2, an A/D converter 40*a* for receiving the signals from the displacement detector 23, the pressure detector 24, the differential pressure detector 25 and the selection command unit 28 to convert them into digital signals, a central processing unit (CPU) 40*b*, a read only memory (ROM) 40*c* for storing a control program therein, a random access memory (RAM) 40*d* for temporarily storing numerical values in the course of operations, and output amplifiers (AMP) 40*f*, 40*g*, 40*h* respectively connected to the flow adjusting valve 2*b* and the solenoid proportional pressure reducing valves 21, 22.

Based on the signals from the displacement detector 23, the pressure detector 24, the differential pressure detector 25 and the selection command unit 28, as well as the control program stored in the ROM 40*c*, the CPU 40*b* calculates displacement volume target values of the hydraulic pump 1 and control force target values of the pressure compensating valves 9, 10, and then outputs the corresponding drive signals to the flow adjusting valve 2*b* and the solenoid proportional pressure reducing valves 21, 22 via the AMP's 40*f*–40*h*, respectively.

Figure 3:
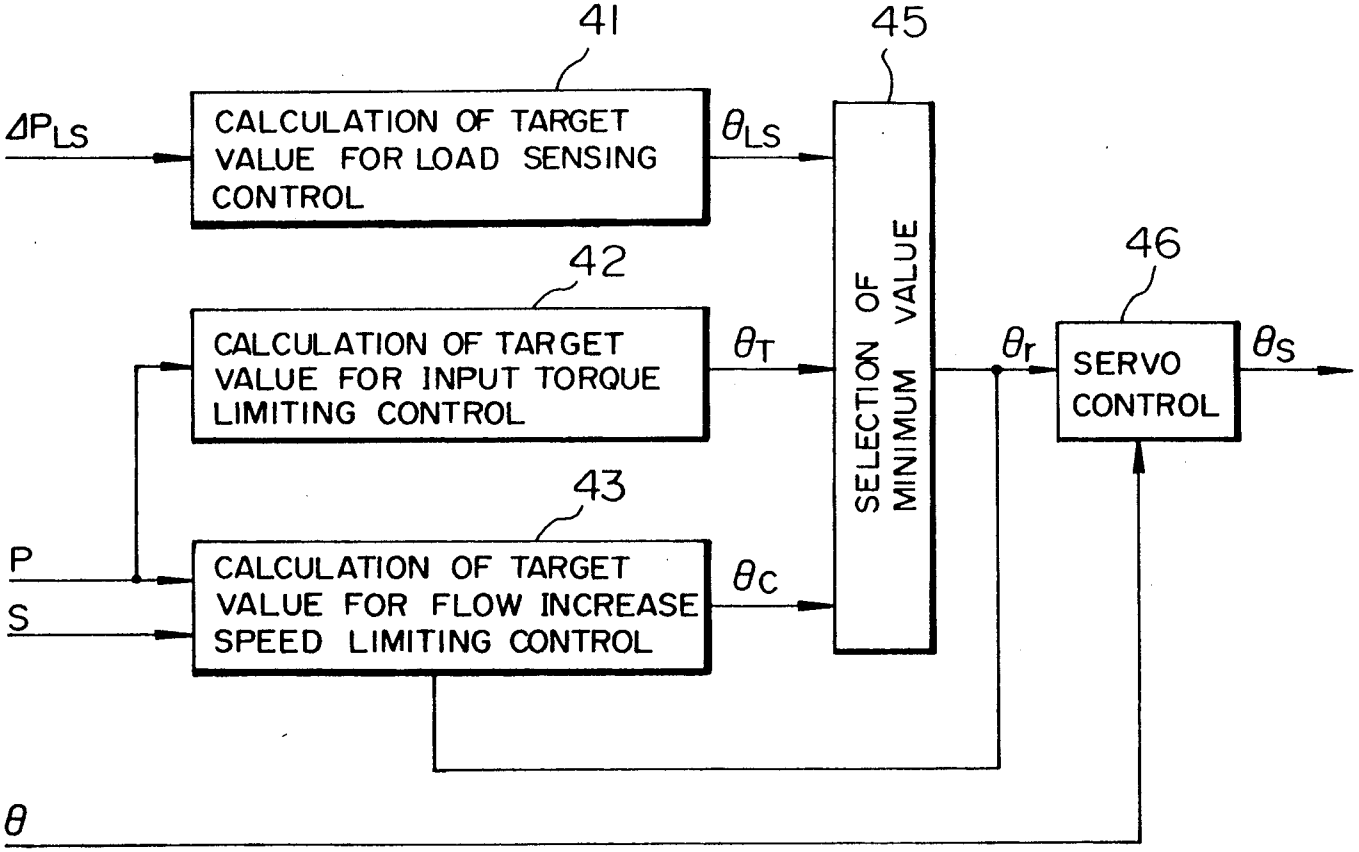
FIG. 3 is a functional block diagram showing a sequence of arithmetic processing for displacement volume target values of a hydraulic pump in the control unit shown in FIG. 1.

A sequence of arithmetic processing for displacement volume target values of the hydraulic pump in the CPU 40*b* is shown in a functional block diagram of FIG. 3. In FIG. 3, a block 41 calculates a displacement volume target value $\theta$LS for load sensing control from the differential pressure $\Delta$PLS detected by the differential pressure detector 25, a block 42 calculates a displacement volume target value $\theta$T for input torque limiting control from the pump delivery pressure P detected by the pressure detector 24, and a block 43 calculates a displacement volume target value $\theta$c for control of limiting a flow increase speed from the pump delivery pressure P and a command signal S from the selection command unit 28.

Here, the load sensing control handled by the block 41 implies that the pump delivery rate is so controlled as to hold the differential pressure (load sensing differential pressure) $\Delta$PLS between the delivery pressure of the hydraulic pump 1 and the maximum load pressure detected by the shuttle valve 11 at a target differential pressure $\Delta$PLSO. The target value $\theta$LS used in so controlling the pump delivery rate may be calculated by, for example, a method as disclosed in U.S. Pat. No. 4,967,557.

Figure 4:
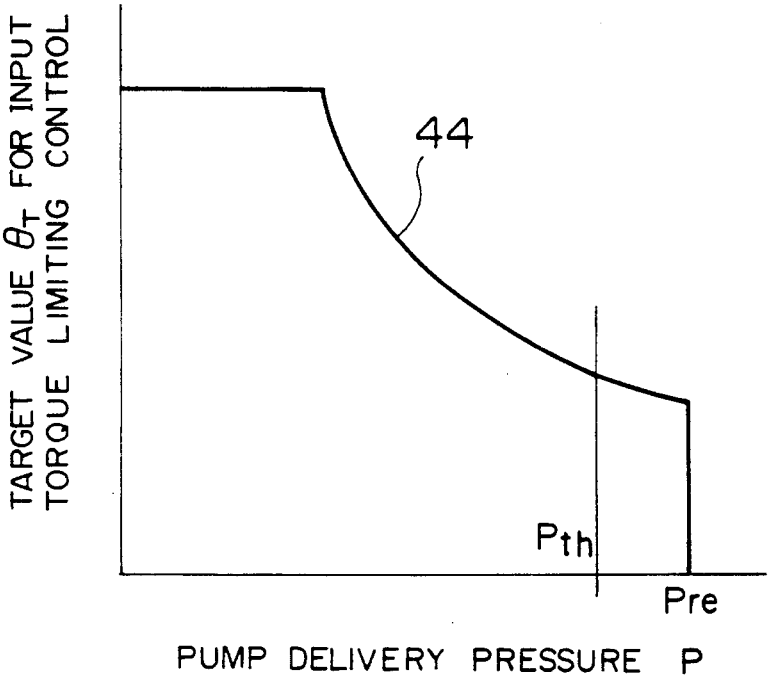
FIG. 4 is a graph showing the functional relation between a pump delivery pressure and a displacement volume target value for input torque limiting control, which relation is to be used in calculating the displacement volume target value.

Also, the input torque limiting control handled by the block 42 implies that the swash plate tilting amount, i.e., the displacement volume, of the hydraulic pump is controlled to reduce the pump delivery rate as the pump delivery pressure is increased and to increase the pump delivery rate as it is reduced. More specifically, the functional relation between the pump delivery pressure P and the displacement volume target value $\theta$T for the input torque limiting control, as shown in FIG. 4, is stored in the ROM 40*c* in advance. Then, the target value $\theta$T corresponding to the pump delivery pressure P is calculated from the functional relation. In this way, the maximum value of the delivery rate of the hydraulic pump 1 is restricted following a curved section 44 in FIG. 4 to limit the input torque so that an engine driving the hydraulic pump 1 may be kept from stalling. It is to be noted that the above control process is also disclosed in the above-cited U.S. Pat. No. 4,967,557.

A function of the block 43 for calculating the displacement volume target value $\theta$c for the flow increase speed limiting control will be described later.

A minimum one of the displacement volume target values $\theta$LS, $\theta$T, $\theta$c determined by the blocks 41–43 is selected by a block 46 and becomes a final displacement volume target value, i.e., a displacement volume command value $\theta$r. This displacement volume command value $\theta$r is compared in a block 46 with the swash plate tilting amount of the hydraulic pump 1 detected by the displacement detector 23, i.e., the actual displacement volume $\theta$, thereby determining a command value $\theta$s for servo control to make a deviation therebetween approach O. The command value $\theta$s is outputted as a drive signal to the flow adjusting valve 2b via the AMP 40f, as mentioned above.

Figure 5:
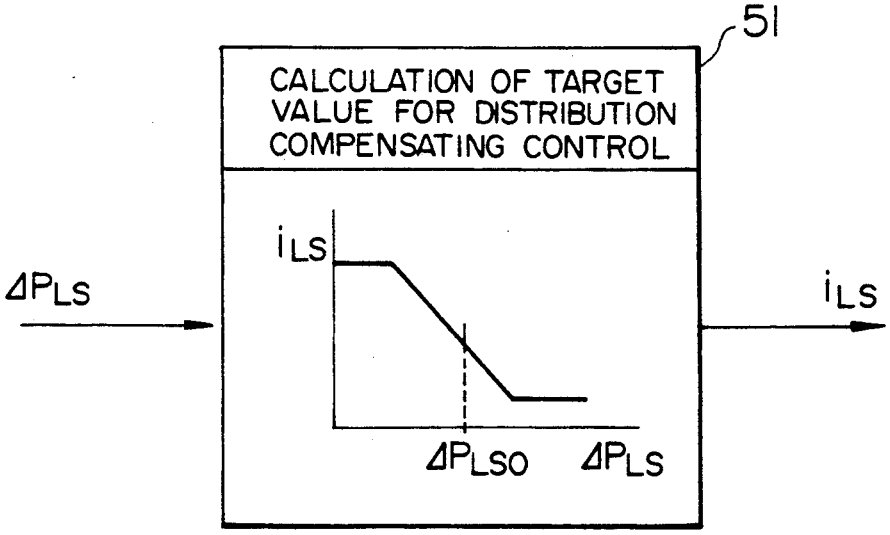
FIG. 5 is a functional block diagram showing a sequence of arithmetic processing for a control force target value of a distribution compensating valve in the control unit shown in FIG. 1.

On the other hand, the control force target values of the pressure compensating valves 9, 10 is calculated in the CPU 40b as shown in FIG. 5. More specifically, the functional relation between the differential pressure ΔPLS and a control force target value iLS such that the control force target value iLS is increased as the differential pressure ΔPLS reduces and is reduced as it increases, as shown in a block 51, is stored in the ROM 40c in advance. Based on that functional relation, the control force target value iLS is calculated from the differential pressure ΔPLS detected by the differential pressure detector 25. Note that ΔPLSO in the block 51 is a target differential pressure for the above-stated load sensing control. Then, the target value iLS determined by the block 51 is outputted as a drive signal to the solenoid proportional pressure reducing valves 21, 22 via the AMP's 40g, 40h, whereupon the solenoid proportional pressure reducing valves 21, 22 output control pressures dependent on the control force target value iLS to the drive parts 9a, 10a of the pressure compensating valves 9, 10, respectively.

Because the drive parts 9a, 10a of the pressure compensating valves 9, 10 are drive parts applying the control forces to act in the valve-closing direction against the springs 9b, 10b, as mentioned above, there develops the relation that the compensated differential pressure target values of the pressure compensating valves 9, 10 become smaller as the control force target value iLS shown in FIG. 5 increases, and become larger as the control force target value iLS reduces. Therefore, the functional relation of FIG. 5 is to eventually calculate the control force target value iLS which makes the compensated differential pressure target values of the pressure compensating valves 9, 10 smaller as the differential pressure ΔPLS reduces, and makes it larger as the differential pressure ΔPLS increases.

By controlling the pressure compensating valves in this way, when the displacement volume target value θT for the input torque limiting control is selected as the command value θr in the block 45 shown in FIG. 3, and then the system comes into a condition that the delivery rate of the hydraulic pump 1 is insufficient with respect to a total demanded flow rate of the flow control valves 7, 8, i.e., a saturated condition of the hydraulic pump 1, there starts distribution compensating control in which the pressure compensating valves 9, 10 are controlled in the direction of restricting their openings to compensate for the flow rates of the hydraulic fluid supplied to the plural actuators 5, 6. Under such a condition, the flow rate(s) of the hydraulic fluid supplied to the hydraulic motor 5 and/or the hydraulic cylinder 6 are determined dependent on the delivery rate of the hydraulic pump. Accordingly, the pump capacity regulation device 2 functions as flow control means adapted to control the flow rate of the hydraulic fluid supplied to the hydraulic cylinder 6. Note that the control target value of the pressure compensating valves 9, 10 may be calculated by a method as disclosed in the above-cited U.S. Pat. No. 4,967,557.

Next, the function of the block 43 shown in FIG. 3 will be described by referring to a flowchart shown in FIG. 6. The block 43 is to provide flow limiting means for controlling the pump capacity regulation device 2 which functions as flow control means to limit an increase in the flow rate of the hydraulic fluid supplied to the hydraulic motor 5 and/or the hydraulic cylinder 6, when the load(s) exerted on the hydraulic motor 5 and/or the hydraulic cylinder 6 is abruptly changed.

First, as shown in a step S1, the delivery pressure P of the hydraulic pump 1 detected by the pressure detector 24 and the command value S from the selection command unit 28 are read into the CPU 40b via the A/D converter 40a as an input section. Then, the control proceeds to a step S2 where a pressure decrease speed (a pressure decrease amount in a predetermined time interval) Pv is calculated in the CPU 40b from a pressure P currently detected and a pressure P last detected. A maximum value Pmax of pressures so far detected, including the currently detected pressure P, is also calculated. These calculated values are stored in the RAM 40d. Afterward, the control proceeds to a step S3. In the step S3, a predetermined speed Pvth stored in the ROM 40c is read into the CPU 40b to determine whether or not the pressure decrease speed Pv calculated in the step S2 is larger than the predetermined speed Pvth. Set as the predetermined speed Pvth is a pressure decrease speed that is usually developed during the ordinary work. Accordingly, if the decision of the step S3 is satisfied, there may occur such an event that the finger tip of the bucket slips over a rock, for example, during the digging work of rocks or the like. Then, the control proceeds to a step S4.

In the step S4, the predetermined pressure Pth stored in the ROM 40c is read into the CPU 40b to determine whether or not the pressure maximum value Pmax stored in the step S2 is larger than the predetermined pressure Pth. As shown in FIG. 4, by way of example, set as the predetermined pressure Pth is a pump delivery pressure that is near a setting pressure Pre of the relief valve 12 and developed during the ordinary work. Accordingly, if the decision of the step S4 is satisfied, this may correspond to such an event that during the digging work of rocks or the like, for example, the system is abruptly changed from a high load condition where the finger tip of the bucket is caught by the rock, into a non-load condition upon its release from the caught state, as mentioned before. Therefore, the control proceeds to a step S20 to start control of limiting a flow increase speed with this embodiment.

In an operating condition where the decision of the step S4 is satisfied, the displacement volume target value θT for the input torque limiting control is selected as the command value θr in the block 45 shown in FIG. 3, and the pump delivery rate is limited to a large extent. In that condition, too, the pump capacity regulation device 2 functions as the flow control means to control the flow rate of the hydraulic fluid supplied to the hydraulic cylinder 6, as mentioned before.

Next, in the step S20, a timer is reset to restart counting to determine whether or not a predetermined time has elapsed after start of the flow increase speed limiting control. At the same time, the status indicating a current state of the flow increase speed limiting control is set to "under execution". Thereafter, the control proceeds to a step S5.

In the step S5, one of plural different increments of the flow rate stored in the ROM 40c which corresponds to the command value S from the selection command unit 28 is read into the CPU 40b and set as an increment Δθ of the pump delivery rate. The increments of the flow rate stored in the ROM 40c are set to values less than an increment of the delivery rate of the hydraulic pump 1 (i.e., a maximum value Δθmax of the delivery rate increment in a step S8 described later) which gives a flow increase speed for the ordinary work. Note that setting the maximum value $\Delta\theta$max as the increment $\Delta\theta$ of the pump delivery rate is equivalent to a mode in which the flow increase speed limiting control is not effected. Then, the control proceeds to a step S10. In the step S10, the displacement volume target value $\theta$c is calculated from both the increment $\Delta\theta$ of the pump delivery rate set in the step S5 and the last displacement volume target value $\theta$r (see FIG. 3). Specifically, operation of $\Delta c = \Delta r + \Delta\theta$ is carried out.

With the displacement volume target value $\theta$c calculated in this way, because the increment $\Delta\theta$ is smaller than the increment $\Delta\theta$max for the ordinary work, the minimum value selection block 45 shown in FIG. 3 which has so far selected the displacement volume target value $\theta$T as the command value $\theta$r as mentioned above, now selects the displacement volume target value $\theta$c as the command value $\theta$r, whereupon a corresponding drive signal is outputted from the AMP 40*f* to the flow adjusting valve 2*b* of the pump capacity regulation device 2 shown in FIG. 1. The flow adjusting valve 2*b* is thereby shifted to drive the control actuator 2*a* so that an increase speed of the displacement volume of the hydraulic pump 1, i.e., a tilting speed of the swash plate, is controlled to become coincident with the increment $\Delta\theta$. As a result, the flow rate of the hydraulic fluid delivered from the hydraulic pump 1 is controlled to increase relatively gentler than would be in the case that the displacement volume target value $\theta$T continues to be selected as the command value $\theta$r. Thus, the hydraulic fluid is supplied at the resulting flow rate to the hydraulic motor 5 and/or the hydraulic cylinder 6 via the pressure compensating valves 9 and/or 10 and the flow control valves 7 and/or 8, respectively, thereby increasing the speed(s) of the hydraulic actuator(s) at a relatively small acceleration.

Figure 6:
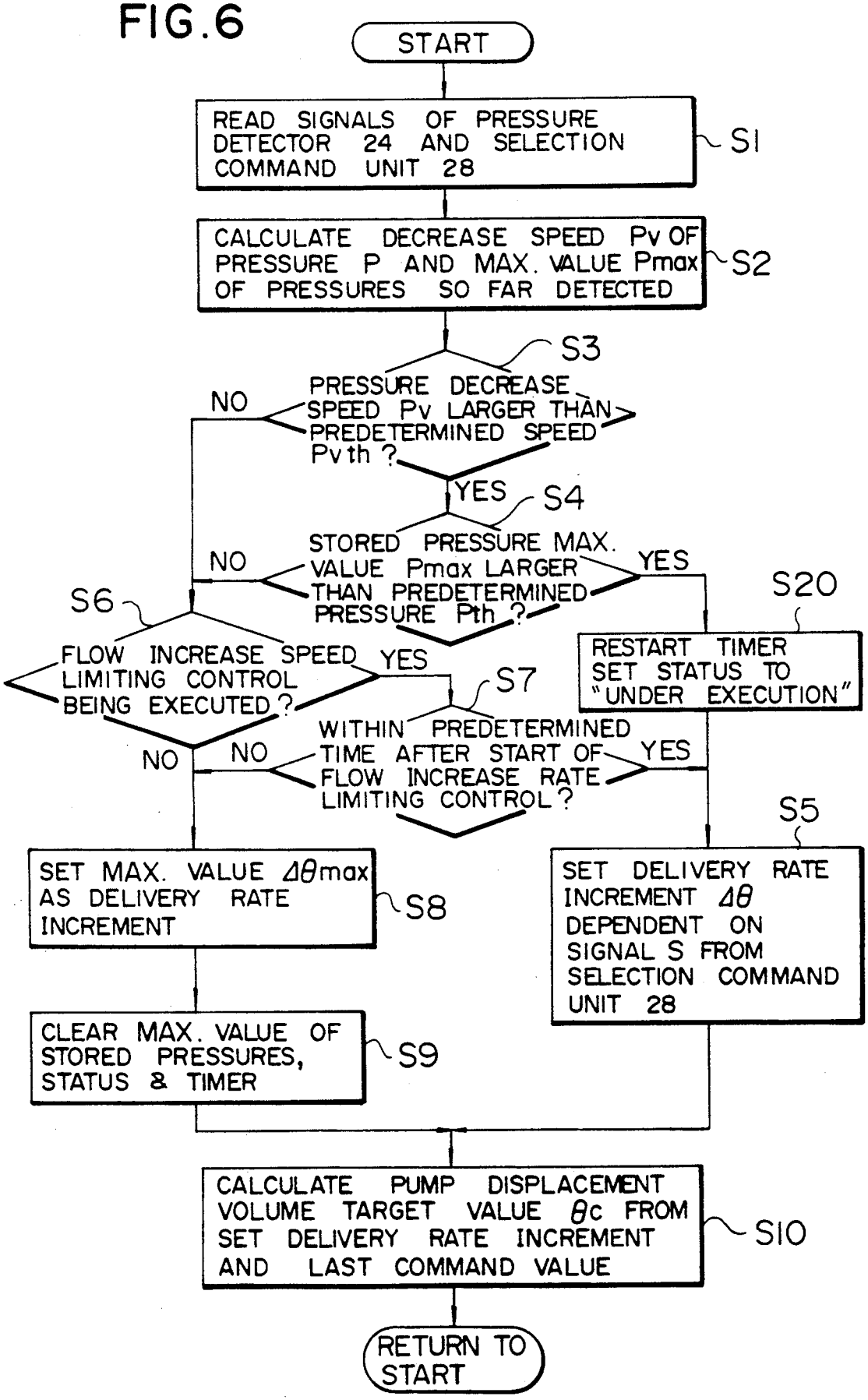
FIG. 6 is a flow chart showing a sequence of processing executed by those ones of the functional blocks shown in FIG. 3 which calculate the displacement volume target value for control of limiting a flow increase speed.

If the decision of the step S3 or the step S4 in the flowchart shown in FIG. 6 is not satisfied, this corresponds to the case that the flow increase speed limiting control is not required, or the case that the same control is being executed, the control S6 proceeding to a step S6. In the step S6, it is determined whether or not the status indicating a current state of the flow increase speed limiting control is set to "under execution". If the decision of the step S6 is satisfied, then the control proceeds to a step S7 to determine whether or not the counting of the timer restarted in the step S20 is within a predetermined value stored in the ROM 40*c*, i.e., whether or not the elapsed time after start of the flow increase speed limiting control is still within the predetermined time, for example, 1 second. If the decision of the step S5 is satisfied, then the control proceeds to the step S7 and further to the step 10 for carrying out the flow increase speed limiting control.

In the case of the ordinary work where the decision of the step S6 is not satisfied, or in the case that the predetermined time has elapsed after start of the counting of the timer and thus the decision of the step S7 is not satisfied, then the control proceeds to a step S8 where the maximum value $\Delta\theta$max of the flow rate increments stored in the ROM 40*c* is read, as an increment of the delivery rate of the hydraulic pump 1 which gives the flow increase speed for the ordinary work, into the CPU 40*b* and that maximum value $\Delta\theta$max is set as the delivery rate increment. Afterward, the control proceeds to a step S9 for processing to clear the maximum value Pmax of the pressures stored in the RAM 40*d*, the status having been set in the step S20 to "under execution", and the timer having been restarted, followed by proceeding to the step S10. In the step S10, based on both the maximum value $\theta$max of the delivery rate increment set in the step S8 and the last displacement volume target value $\theta$r (see FIG. 3), operation of $\theta c = \theta r + \theta max$ is carried out to determine the displacement volume target value $\theta$c.

With the displacement volume target value $\theta$c thus calculated in the step S10, the minimum value selection block 45 shown in FIG. 3 now selects a minimum one of the displacement volume target values $\theta$LS, $\theta$T and $\theta$c as the command value $\theta$r, whereupon a corresponding drive signal is outputted from the AMP 40*f* to the flow adjusting valve 2*b* of the pump capacity regulation device 2 shown in FIG. 1. The hydraulic fluid is thereby supplied to the hydraulic motor 5 and/or the hydraulic cylinder 6 at the flow rate corresponding to the maximum increase speed, so that the speed(s) of the hydraulic actuator(s) is increased at a relatively large acceleration required for the ordinary work.

Figure 7A:
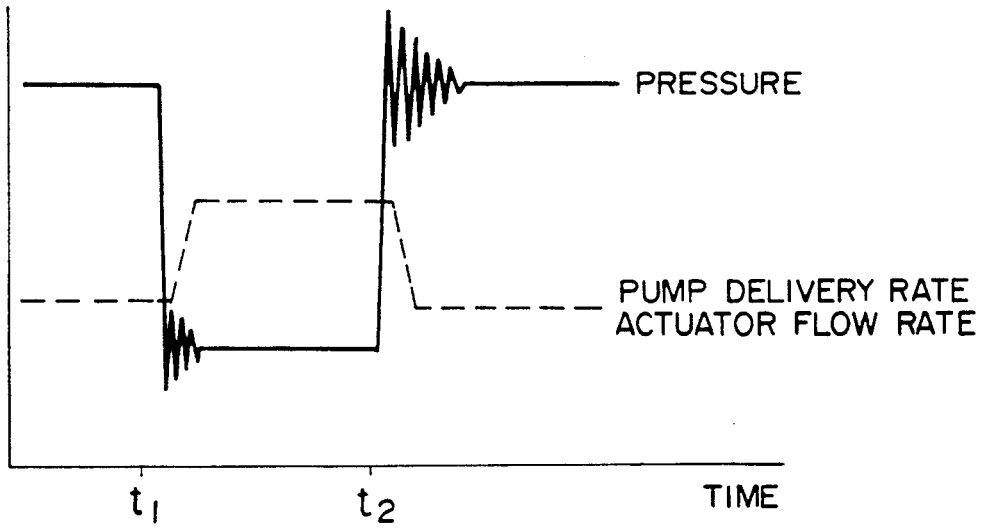
FIGS. 7(*a*) and 7(*b*) are charts showing characteristics in the cases of not performing and performing the flow increase speed limiting control with the first embodiment, respectively.
Figure 7B:
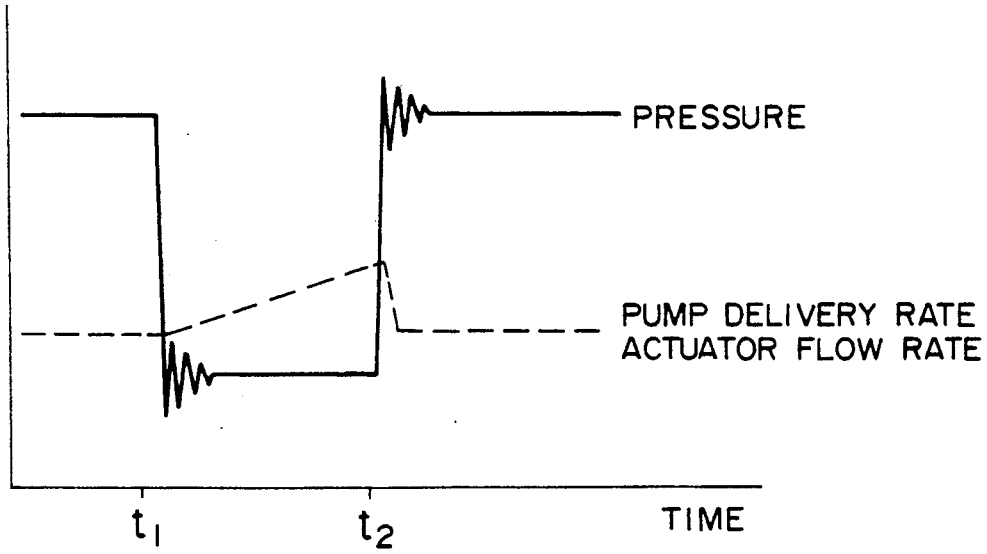

FIG. 7 shows characteristics of change in the pump delivery pressure and change in the pump delivery rate and also the flow rate passing through the actuator as produced in such an event that during the digging work of rocks or the like, the system is abruptly changed from a high load condition where the finger tip of the bucket is caught by the rock, into a non-load condition upon its release from the caught state. FIG. 7(*a*) represents the case of not performing the flow increase speed limiting control, whereas FIG. 7(*b*) represents the case of performing the flow increase speed limiting control. In the charts of FIGS. 7(*a*) and 7(*b*), the time t1 stands for the point in time at which during the digging work of rocks or the like, a high load condition where the finger tip of the bucket is caught by the rock abruptly turns to a non-load condition where it is released from the caught state. The time t2 stands for the point in time at which after abrupt turning to the non-load condition upon release from the caught state, the finger tip of the bucket strikes against the rock intended by the operator to be next dug.

In the case of not performing the control of this embodiment, as shown in FIG. 7(*a*), the input torque limiting control is ceased upon an abrupt reduction in the pressure to abruptly increase the pump delivery rate, whereby the flow rate of the hydraulic fluid supplied to the hydraulic motor 5 and/or the hydraulic cylinder 6 is also abruptly increased correspondingly. Therefore, the actuator speed is accelerated beyond a required level at the time t2, causing the bucket to strike at a resulting large speed against the rock intended by the operator to be next dug. The occurrence of such a collision imposes a heavy impact load on the hydraulic excavator body, hydraulic system and so forth, and thus remarkably cuts down on the service life of the hydraulic excavator as a structure. Further, the above collision transmits a heavy impact to an operating cab installed on the machine body as well, making the operator in the cab more fatigued.

Meanwhile, in the case of performing the control of this embodiment, as shown in FIG. 7(*b*), an abrupt reduction in the pressure allows the displacement volume target value $\theta$c to be selected as the command value $\theta$r, as mentioned above, whereby the delivery rate of the hydraulic pump 1 is controlled to increase relatively gently, as is the flow rate of the hydraulic fluid supplied to the hydraulic motor 5 and/or the hydraulic cylinder 6. Consequently, the actuator speed is prevented from reaching an excessively accelerated level at the time t2.

With this embodiment, therefore, it is possible to suppress a collision of the finger tip of the bucket against rocks, reduce an impact exerted on the body and hydraulic system of a construction machine equipped with the present drive system, and further prevent such an impact from reducing down the service life of the construction machine and also from making the operator in the cab installed on the body more fatigued.

Second Embodiment

A second embodiment of the present invention will be described with reference to FIGS. 8–10. In this embodiment, the pressure compensating valves 9, 10 are adopted as flow control means for carrying out the flow increase speed limiting control, and drive speeds of the pressure compensating valves 9, 10 are controlled to limit an increase speed of the flow rate of the hydraulic fluid supplied to the actuator 7 or 8. Note that the hardware configuration of this embodiment is essentially the same as that of the first embodiment shown in FIGS. 1 and 2, which will be referred to in the following explanation of this embodiment as well.

Figure 8:
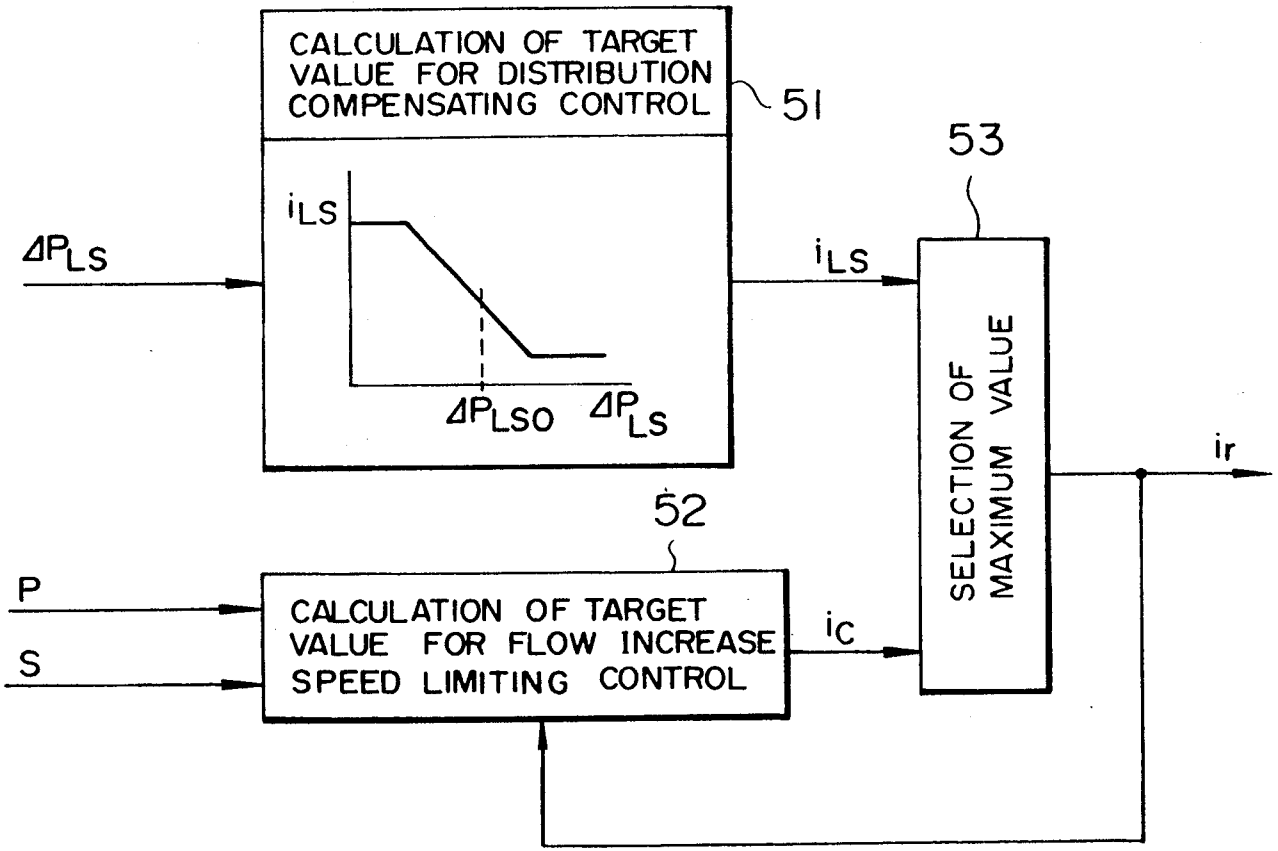
FIG. 8 is a functional block diagram showing a sequence of arithmetic processing for the control force target value of the distribution compensating valve according to a second embodiment of the present invention.

In this embodiment, control force target values of the pressure compensating valves 9, 10 are calculated in the CPU 40*b* of the control unit 40 as shown in FIG. 8. More specifically, in a block 51, the control force target value iLS for the distribution compensating control is calculated like the first embodiment shown in FIG. 5. In a block 52, a control force target value ic for the flow increase speed limiting control is calculated from the pump delivery pressure P and the command signal S from the selection command unit 28. A larger one of the control force target values iLS and ic is selected as a command value ir by a block 53. Then, the command value ir is outputted as a drive signal to the solenoid proportional pressure reducing valves 21, 22 via the AMP's 40*g*, 40*h*, whereupon the solenoid proportional pressure reducing valves 21, 22 output control pressures dependent on the command value ir to the drive parts 9*a*, 10*a* of the pressure compensating valves 9, 10, respectively.

An arithmetic function of calculating the pump displacement volume target value in the ROM 40*c* of the control unit 40 is the same as that resulted by omitting the function of the block 43 from the configuration shown in FIG. 3. Thus, a smaller one of the displacement volume targert value $\theta$LS for the load sensing control and the displacement volume target value $\theta$T for the input torque limiting control is selected as the command value $\theta$r for use in controlling the pump capacity regulation device 2.

The function of the block 52 shown in FIG. 8 will be explained by referring to a flowchart shown in FIG. 9.

Steps S1–S4 and steps S6, S7, S9 and S20 are the same as those in the first embodiment shown in FIG. 6. In an operating condition where the decision of the step S4 is satisfied, the displacement volume target value $\theta$T for the input torque limiting control is selected as the command value $\theta$r in the block 45 shown in FIG. 3 and the pump delivery rate is limited to a large extent, as mentioned before. Accordingly, because the load sensing differential pressure $\Delta$PLS is smaller than the target differential pressure $\Delta$PLSO, a control force target value iLS larger than usual is calculated in the block 51 in FIG. 8 and the pressure compensating valves 9, 10 are in a correspondingly restricted state.

In a step S5A, one of plural different increments of the flow rate stored in the ROM 40*c* which correspond to the command value S from the selection command unit 28 is read into the CPU 40*b* and set as an increment $\Delta$q of the flow rates passing through the flow control valves 7, 8. The increments of the flow rate stored in the ROM 40*c* are set to values less than an increment of the flow rates passing thorough the flow control valves 7, 8, i.e., a maximum value $\Delta$qmax of the flow rate increment, which gives a flow increase speed for the ordinary work.

Then, the control proceeds to a step S10A. In the step S10A, the control force target value ic of the pressure compensating values 9, 10 is calculated from both the increment $\Delta$q of the flow rate set in the step S5A and the last command value ir (see FIG. 8). Specifically, this operation is carried out in view of the fact that the flow rates passing thorough the flow control valves 7, 8 and the control forces applied to the pressure compensating valves 9, 10 are increased and decreased in opposite directions. For example, the increment $\Delta$i of the control force target value is calculated from the increment $\Delta$q of the valve passing flow rate through operation of $\Delta i = -\Delta q \times k$ (k is a coefficient), and ic is calculated through operation of $ic = ir + \Delta i$.

With the control force target value ic thus calculated in the step S10A, because the increment $\Delta$q is smaller than the increment $\Delta$qmax for the ordinary work, the maximum value selection block 53 shown in FIG. 8 which has so far selected the control force target value iLS as the command value ir, now selects the control force target value ic as the command value ir, whereupon corresponding drive signals are outputted from the AMP's 40*g*, 40*h* to the solenoid proportional pressure reducing valves 21, 22 shown in FIG. 1. The drive parts 9*a*, 10*a* of the pressure compensating valves 9, 10 are thereby loaded with corresponding control pressures to control drive speeds of the pressure compensating valves 9, 10 in the valve-opening direction. Stated otherwise, in the case of continuing to select the control force target value iLS as the command value ir, an increase in the pump delivery rate would increase the load sensing differential pressure $\Delta$PLS and thus reduce the control force target value iLS, so that the pressure compensating valves 9, 10 in their restricted state would be opened at a maximum speed. In contrast, this embodiment makes control so as to gradually raise the drive speeds of the pressure compensating valves 9, 10. As a result, the flow rates of the hydraulic fluid passing through the flow control valves 7, 8 are controlled to increase relatively gently, whereby the hydraulic fluid is supplied at the resulting flow rates to the hydraulic motor 5 and/or the hydraulic cylinder 6 via the pressure compensating valves 9 and/or 10 for increasing the speed(s) of the hydraulic actuator(s) at a relatively small acceleration.

In a step S8A, the maximum value $\Delta$qmax of the flow rate increments stored in the ROM 40*c* is read, as an increment of the flow rates passing through the flow control valves 7, 8 which gives the flow increase speed for the ordinary work, into the CPU 40*b* and is set as the flow rate increment. Afterward, the control proceeds to a step S9 for processing to clear the maximum value Pmax of the pressures stored in the RAM 40*d*, the status and the timer, followed by proceeding to the step S10A. In the step S10A, the control force target value ic is calculated in a like manner to the above first embodiment.

With the control force target value ic thus calculated in the step S10A, the maximum value selection block 53 shown in FIG. 8 now selects the control force target value iLS for the distribution compensating control as the command value ir, so that the pressure compensating valves 9, 10 are brought into a normal controlled state.

Figure 10A:
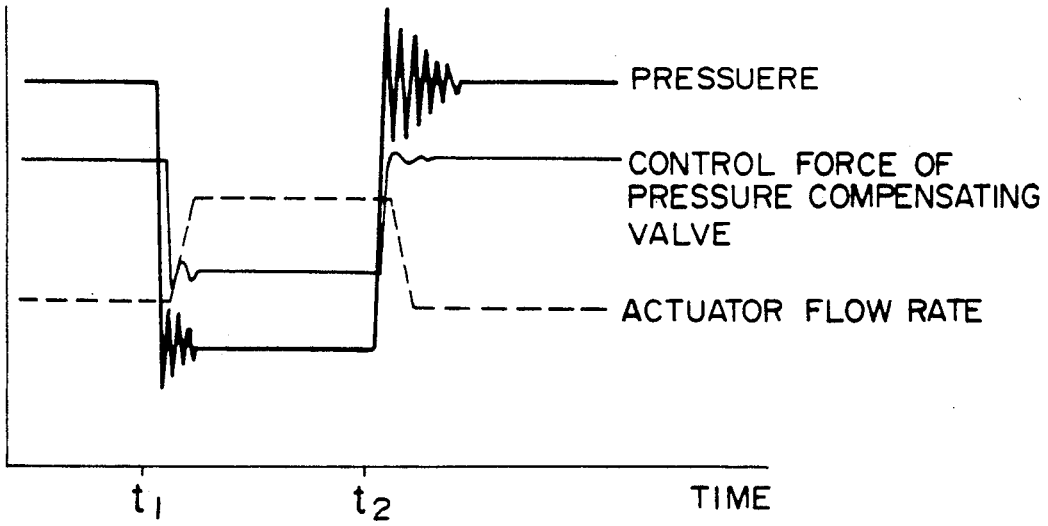
FIGS. 10(*a*) and 10(*b*) are charts showing characteristics in the cases of not performing and performing the flow increase speed limiting control with the second embodiment, respectively.
Figure 10B:
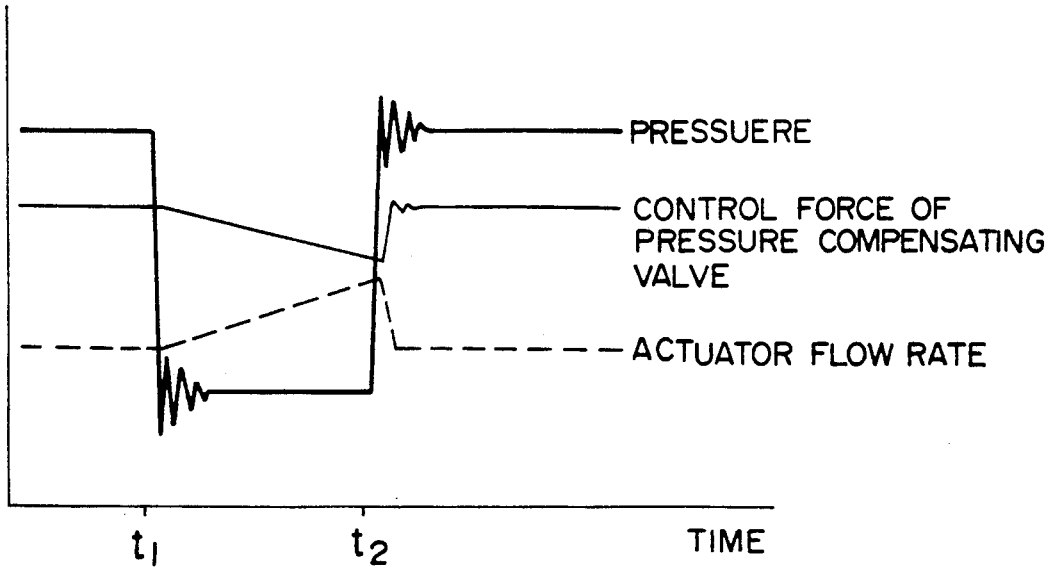

FIG. 10 shows characteristics of change in the pump delivery pressure and change in the control force of the pressure compensating valve and also the flow rate passing through the actuator as produced in such an event that during the digging work of rocks or the like, the system is abruptly changed from a high load condition where the finger tip of the bucket is caught by the rock, into a non-load condition upon its release from the caught state. FIG. 10(*a*) represents the case of not performing the flow increase speed limiting control, whereas FIG. 10(*b*) represents the case of performing the flow increase speed limiting control. In the charts of FIGS. 10(*a*) and 10(*b*), the time t1 stands for the point in time at which during the digging work of rocks or the like, a high load condition where the finger tip of the bucket is caught by the rock abruptly turns to a non-load condition where it is released from the caught state. The time t2 stands for the point in time at which after abrupt turning to the non-load condition upon release from the caught state, the finger tip of the bucket strikes against the rock intended by the operator to be next dug.

In the case of not performing the control of this embodiment, as shown in FIG. 10(*a*), the input torque limiting control is ceased upon an abrupt reduction in the pressure to abruptly increase the pump delivery rate, whereby the control forces of the pressure compensating valves 9, 10 so far held in a restricted state are abruptly reduced to bring the valves 9, 10 into a full-open state correspondingly and, therefore, the flow rate of the hydraulic fluid supplied to the hydraulic motor 5 and/or the hydraulic cylinder 6 is also abruptly increased. Consequently, the actuator speed is accelerated beyond a required level at the time t2, causing the bucket to strike at a resulting large speed against the rock intended by the operator to be next dug.

Meanwhile, in the case of performing the control of this embodiment, as shown in FIG. 10(*b*), an abrupt reduction in the pressure allows the control force target value ic to be selected as the command value ir, as mentioned above, whereby the control forces of the pressure compensating valves 9, 10 are gradually reduced and the drive speeds of the pressure compensating valves 9, 10 are gradually increased. Thus, the openings of the pressure compensating valves 9, 10 are gradually increased. Accordingly, the flow rates of the hydraulic fluid passing through the flow control valves 7, 8 are controlled to increase relatively gently, as is the flow rate of the hydraulic fluid supplied to the hydraulic motor 5 and/or the hydraulic cylinder 6. As a result, the actuator speed is prevented from reaching an excessively accelerated level at the time t2.

Consequently, this embodiment can also provide a similar advantageous effect to the above first embodiment.

Third Embodiment

A third embodiment of the present invention will be described with reference to FIG. 11. In this embodiment, the decision as to whether or not to start the flow increase speed limiting control is made based on only a value of the pump delivery pressure for the purpose of obviating an inconvenience caused by an abrupt reduction in the pump delivery pressure. Thus, this embodiment is different from the first embodiment in the function of the block 43 in the functional block diagram of FIG. 3 as follows.

Figure 11:
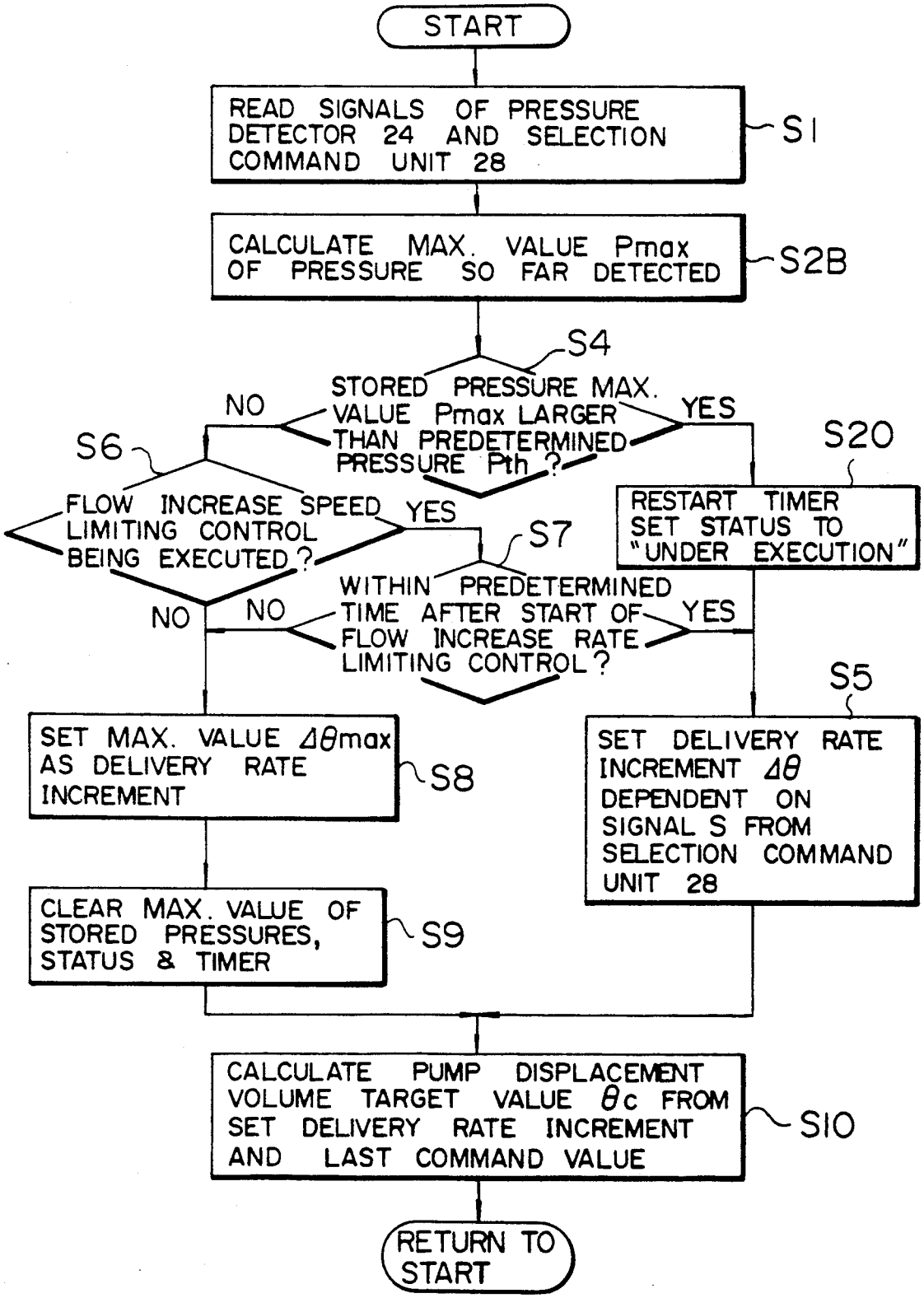
FIG. 11 is a flow chart showing a sequence of processing to calculate the displacement volume target value for control of limiting a flow increase speed according to a third embodiment of the present invention.
Figure 12:
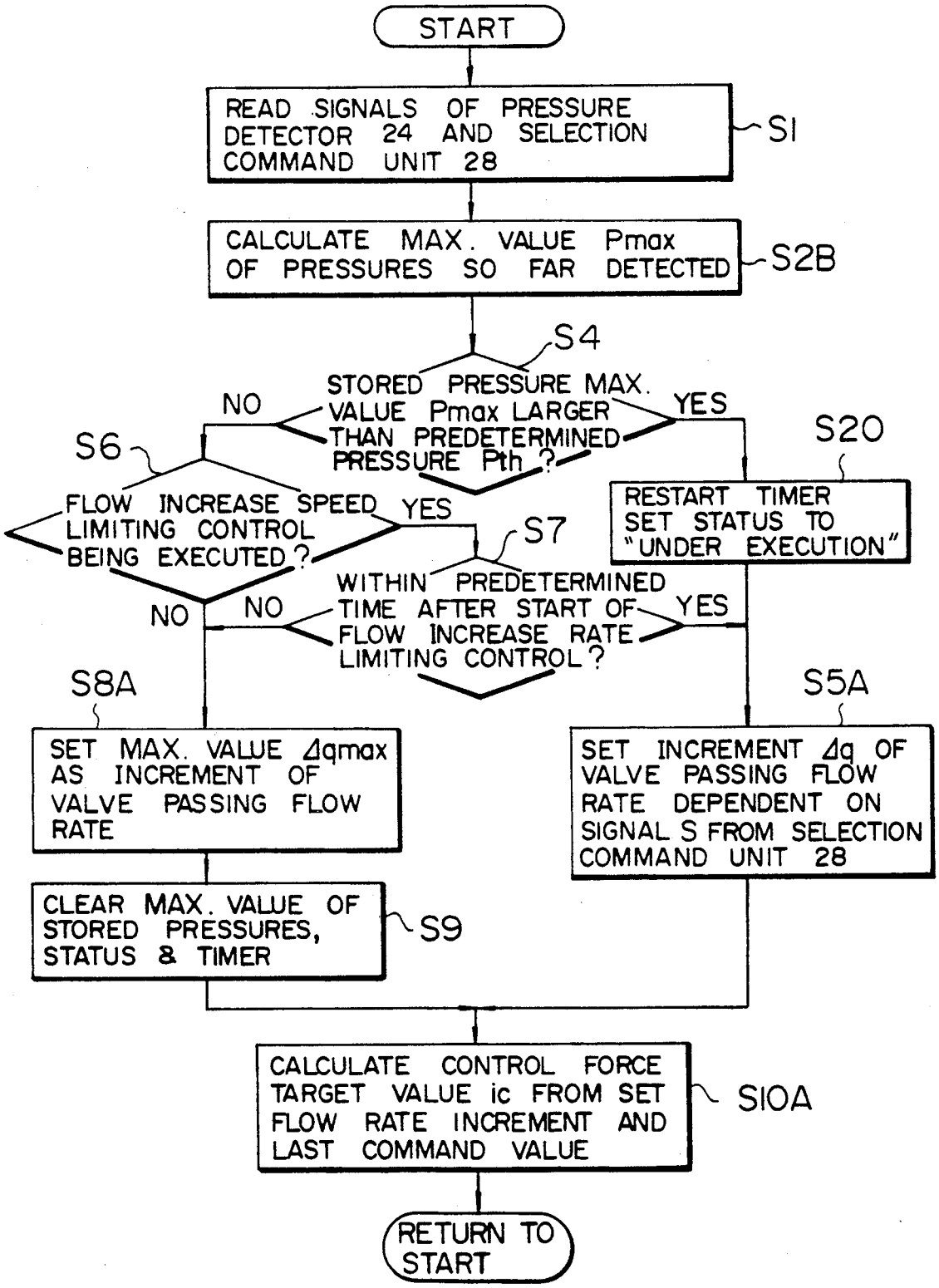
FIG. 12 is a flow chart showing a sequence of processing to calculate the control force target value for control of limiting a flow increase speed according to a similar concept to the third embodiment shown in FIG. 11.

FIG. 11 shows a function of the block 43 according to this embodiment in the form of a flowchart in which the same steps as those in the flowchart of FIG. 6 are denoted by the same reference symbols. As will be seen from comparison of the reference symbols, this embodiment is different from the first embodiment in that only the maximum value Pmax of the pump delivery pressure P is calculated and stored in a step S2B, and that the step S33 in the first embodiment is eliminated.

More specifically, in FIG. 11, the delivery pressure P of the hydraulic pump 1 detected by the pressure detector 24 and the command value S from the selection command unit 28 are read into the CPU 40*b* in the step S1. Thereafter, the step S2B calculates the maximum value Pmax of pressures so far detected, including the currently detected pressure P, the calculated maximum value being stored in the RAM 40*d*. Then, the control proceeds to a step S4 where the predetermined pressure Pth stored in the ROM 40*c* is read into the CPU 40*b* to determine whether or not the pressure maximum value Pmax stored in the step S2 is larger than the predetermined pressure Pth. If the decision of the step S4 is satisfied, this corresponds to the case that a high load is exerted on the actuator, for example, as produced in such an event that during the digging work of rocks or the like, the finger tip of the bucket is caught by the rock to develop the high load. In the event like this, the system is abruptly changed from a high load condition where the finger tip of the bucket is caught by the rock, into a non-load condition upon its release from the caught state. In anticipation of such a probability, the control proceeds to a step S20 to the flow increase speed limiting control with this embodiment.

The processing is carried out by the step S20 and subsequently flows to a step S5 in the same way as in the first embodiment. Specifically, during a period after restart of the timer in the step S20 until elapse of the predetermined time, the displacement volume target value $\Delta c$ calculated from the increment $\theta\Delta$ set in the step S5 is selected as the command value $\theta r$ by the minimum value selection block 45 in FIG. 3 to carry out the flow increase speed limiting control.

With this embodiment, during the digging work of rocks or the like, when a high load condition where the finger tip of the bucket is caught by the rock abruptly turns to a non-load condition upon its release from the caught state, the system has already shifted into the flow increase speed limiting control to enable acceleration control of the actuator with good response. As a result, the advantageous effect of the first embodiment can be also secured in this embodiment with higher reliability.

While this embodiment has been explained as modifying a part of the first embodiment, a similar modification may be applied to the second embodiment which adopts, as the flow control means for carrying out the flow increase rate limiting control, the pressure compensating valves 9, 10 in place of the pump capacity regulation device 2. In that modification, it is also possible to obtain the similar advantageous effect to the above-stated embodiment.

Other Embodiments

Figure 9:
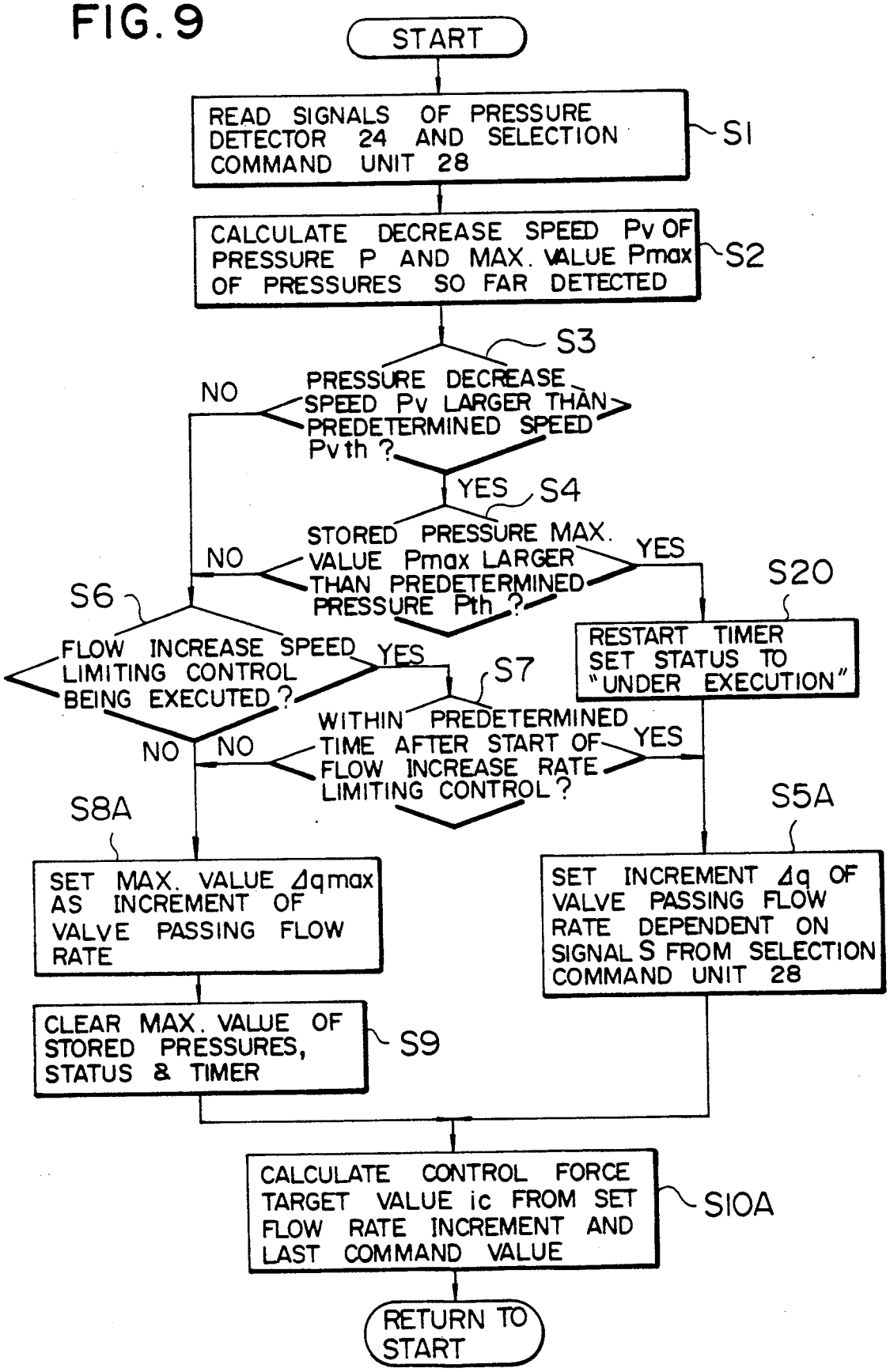
FIG. 9 is a flow chart showing a sequence of processing executed by those ones of the functional blocks shown in FIG. 8 which calculate the control force target value for control of limiting a flow increase speed.
Figure 13:
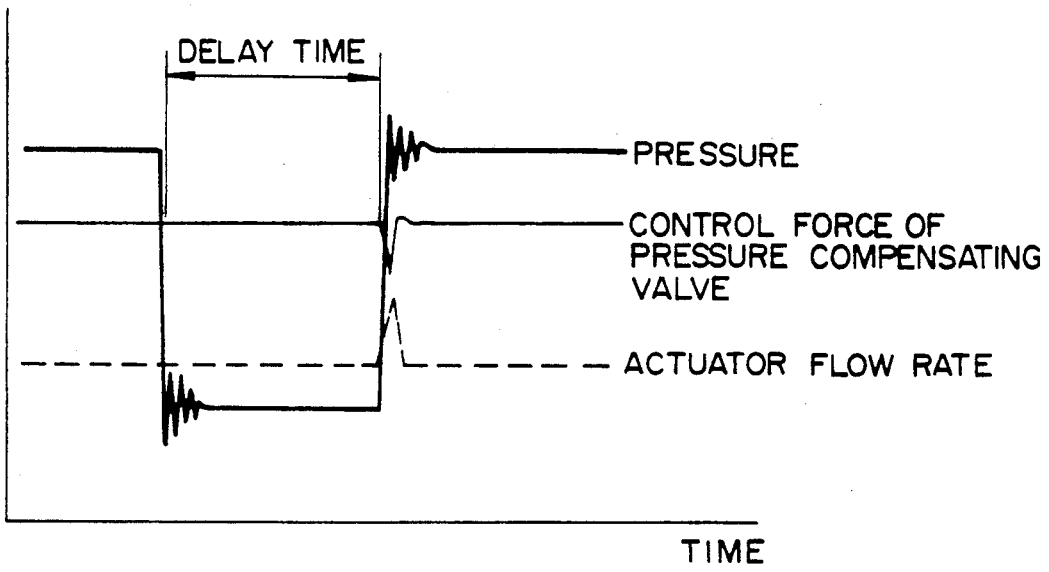
FIGS. 13 and 14 are charts showing characteristics in the cases of setting an increment of the flow rate to 0 and a time-dependent variable value in the flow increase speed limiting control, respectively.

Although in the foregoing embodiments, e.g., in the step S5A of the flowchart shown in FIG. 9, the flow rate increment read and set by the command signal from the selection command unit 28 is considered to be a value other than 0, that increment may be set to 0. In this case, as shown in FIG. 13, the pressure compensating valve is held in a state immediately before an abrupt reduction in the pump delivery pressure, for a period of the predetermined time set by the timer. Thus, the set predetermined time functions as a delay time in control of the pressure compensating valve. Accordingly, even if the finger tip of the bucket strikes against the rock to be next dug during the above delay time, the actuator speed is not so increased that an impact caused by the collision can be alleviated.

Figure 14:
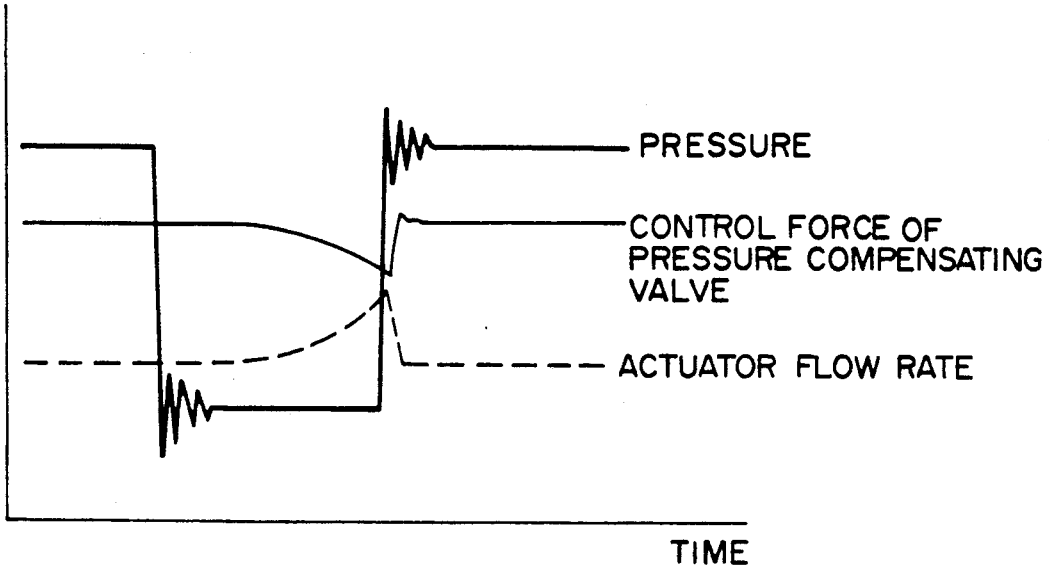

Although in the foregoing embodiments, e.g., likewise in the step S5A of the flowchart shown in FIG. 9, the flow rate increment read and set by the command signal from the selection command unit 28 is considered to be a fixed value that may be set as a variable value which increases following a predetermined pattern over time. In this case, the control force of the pressure compensating valve and the flow rate passing through the actuator are changed as shown in FIG. 14, thereby providing the similar advantageous effect.

Further, in the foregoing embodiments, the predetermined speed Pvth stored in the ROM 40*c* of the control unit 40 is not necessarily a unique value, and may take different values dependent upon the types of work. Alternatively, if necessary, it may be stored in advance so as to cover a predetermined range of speeds, or may be optionally set and changed by the operator.

Likewise, the predetermined pressure Pth stored in the ROM 40*c* of the control unit 40 is not necessarily a unique value, and may take different values dependent upon types of work such as so-called heavy and light digging work. Alternatively, if necessary, it may be stored in advance so as to cover a predetermined range of pressures, or may be optionally set and changed by the operator.

Although the foregoing embodiments are arranged to detect an abrupt reduction in the load by detecting the delivery pressure of the hydraulic pump, the present invention is not limited to this arrangement. Alternatively, the hydraulic system may be arranged to directly detect the load pressure of the actuator, or detect stress change in the surface of a working member like the bucket.

In addition, the foregoing embodiments are arranged to store plural different increments for the flow increase speed limiting control in the ROM 40*c* of the control unit 40, and select one of those increments in response to the command from the selection command unit 28. However, the hydraulic system may be arranged to store in the ROM 40*c* both a maximum value of the increment corresponding to the maximum speed during the ordinary work and one increment value smaller than the maximum value, and to select one of a normal operation mode and a limiting control mode of the flow increase speed by actuating selection command unit 28. With this alternative, the maximum value of the increment is set when the normal operation mode is selected, and the increment value smaller than the maximum value is set when the limiting control mode of the flow increase speed is selected.

Moreover, the drive part of the pressure compensating valve may act not in the valve-closing direction, but in the valve-opening direction. In this case, because the compensated differential pressure target value becomes larger with an increase in the control force, it is only required to make a modification to reverse directions of the characteristics correspondingly.

According to the arrangement explained above, the hydraulic drive system for construction machines of the present invention can prevent an abrupt increase in the speed of a hydraulic actuator incidental to such an abrupt drop of the load as not caused during an ordinary work. Therefore, even if the load is abruptly reduced during the ordinary work upon the occurrence of an unexpected event unlike the ordinary work, the speed of the hydraulic actuator will not be raised beyond a required level so that an impact of working member driven by the hydraulic actuator can be alleviated due to the aforementioned drop of the load. As a result, it is possible to reduce an impact load exerted on the body and hydraulic system of a construction machine equipped with the present hydraulic drive system, and to keep a longer service life of the construction machine and also allow the operator in the cab installed on the body to become less fatigued than conventionally.

I claim:

1. A hydraulic drive system for a construction machine comprising a hydraulic pump of variable displacement type, a hydraulic actuator driven by a hydraulic fluid delivered from said hydraulic pump, flow control means for controlling a flow rate of the hydraulic fluid supplied to said actuator, and pump control means for controlling a delivery rate of said hydraulic pump such that the pump delivery rate is reduced as a load of said actuator increases, and is increased as the load of said actuator reduces, said hydraulic drive system further comprising:

first detection means for detecting a magnitude of the load exerted on said actuator;

flow limiting means for monitoring an abrupt reduction in the load of said actuator based on a signal from said first detection means, and controlling said flow control means to limit a flow increase speed of the hydraulic fluid supplied to said actuator when it is determined that said actuator has reached a predetermined condition related to an abrupt reduction in the load; and said flow limiting means including means for determining that said actuator has reached said predetermined condition related to an abrupt reduction in the load, when at least the load of said actuator detected by said first detection means is larger than a predetermined value.

2. A hydraulic drive system for a construction machine according to claim 1 in which said flow control means includes said pump flow control means, wherein said flow limiting means is pump flow limiting means for limiting an increase in speed of the delivery rate of said hydraulic pump controlled by said pump flow control means when it is determined that said actuator has reached a predetermined condition related to an abrupt reduction in the load.

3. A hydraulic drive system for a construction machine according to claim 2 in which said pump flow control means includes means for calculating a first displacement volume target value ($\theta T$) for input torque limiting control of said hydraulic pump, wherein said pump flow limiting means includes means for calculating a second displacement volume target value ($\theta c$) to limit an increase speed of said pump delivery rate, and means for selecting a smaller value of said first displacement volume target value and said second displacement volume target value, and outputting the selected value as a displacement volume command value ($\theta r$).

4. A hydraulic drive system for a construction machine according to claim 1 in which said flow control means includes a flow control valve for controlling the flow rate of the hydraulic fluid supplied from said hydraulic pump to said actuator, and a pressure compensating valve for controlling a differential pressure across said flow control valve, wherein said flow limiting means is valve control means for controlling a drive speed of said pressure compensating valve in the valve-opening direction and limiting an increase in speed of the flow rate passing through said flow control valve when it is determined that said actuator has reached a predetermined condition related to an abrupt reduction in the load.

5. A hydraulic drive system for a construction machine according to claim 4 further comprising second detection means for detecting a differential pressure between a delivery pressure of said hydraulic pump and a load pressure of said actuator, and means for calculating a first control force target value that causes a compensated differential pressure target value of said pressure compensating valve to become smaller as said differential pressure is reduced, and to become larger as said differential pressure is increased, wherein said valve limiting means includes means for calculating a second control force target value (ic) to limit an increase speed of the flow rate passing through said flow control valve, and means for selecting a smaller value of said first control force target value (iLS) and said second control force target value (ic), and outputting the selected value as a command value (ir).

6. A hydraulic drive system for a construction machine according to claim 1, wherein said flow limiting means includes setting means for setting a first flow rate increment ($\Delta\theta$max) giving a flow increase speed adapted for an ordinary work and a second flow rate increment ($\Delta\theta$) smaller than said first flow rate increment, selection means (S3, S4) for selecting said first flow rate increment when it is not determined that said actuator has reached a predetermined condition related to an abrupt reduction in the load, and selecting said second flow rate increment when it is determined that said actuator has reached a predetermined condition related to an abrupt reduction in the load, and arithmetic means for calculating a control target value of the flow rate supplied to said actuator based on said selected flow rate increment.

7. A hydraulic drive system for a construction machine according to claim 6, wherein said setting means includes means for storing a plurality of different flow rate increments, and means operable externally for selecting one of said increments as said second flow rate increment ($\Delta\theta$) dependent upon the operation thereof.

8. A hydraulic drive system for a construction machine according to claim 6, wherein said second flow rate increment ($\Delta\theta$) is 0.

9. A hydraulic drive system for a construction machine according to claim 6, wherein said second flow rate increment ($\Delta\theta$) is a time-dependent variable value.

10. A hydraulic drive system for a construction machine according to claim 1, wherein said flow limiting means further includes means for calculating a magnitude decrease speed (Pv) of the load of said actuator based on a signal from said first detection means, said determining means determining that said actuator has reached said predetermined condition related to an abrupt reduction in the load, when said load magnitude decrease speed is larger than said predetermined value (Pvth) and the load (Pmax) of said actuator is larger than a predetermined value (Pth).

11. A hydraulic drive system for a construction machine according to claim 1, wherein said first detection means is means for detecting a delivery pressure (P) of said hydraulic pump (1).

12. A hydraulic drive system for a construction machine comprising a hydraulic pump of variable displacement type, a hydraulic actuator driven by a hydraulic fluid delivered from said hydraulic pump, flow control means for controlling a flow rate of the hydraulic fluid supplied to said actuator, and pump control means for controlling a delivery rate of said hydraulic pump such that the pump delivery rate is reduced as a load of said actuator increases, and is increased as the load of said actuator reduces, said hydraulic drive system further comprising:

first detection means for detecting a magnitude of the load exerted on said actuator; and flow limiting means for monitoring an abrupt reduction in the load of said actuator based on a signal from said first detection means, and controlling said flow control means to limit a flow increase speed of the hydraulic fluid supplied to said actuator when it is determined that said actuator has reached a predetermined condition related to an abrupt reduction in the load;

said flow limiting means including means for setting a first flow increase speed adapted for an ordinary work and second flow increase speed smaller than said first flow increase speed, means for selecting said first flow increase speed when it is not determined that said actuator has reached said predetermined condition related to an abrupt reduction in the load, and selecting said second flow increase speed when it is determined that said actuator has reached said predetermined condition related to an abrupt reduction in the load, and means for controlling said flow control means based on the selected flow increase speed.

* * * * *